US007861678B2

(12) United States Patent
McClellan

(10) Patent No.: US 7,861,678 B2
(45) Date of Patent: Jan. 4, 2011

(54) HIGH-EFFICIENCY WATER HEATER DIP TUBE AND METHOD FOR REDUCING TURBULENCE IN WATER HEATERS

(76) Inventor: W. Thomas McClellan, 2680 Arbor Dr., Fort Lauderdale, FL (US) 33312

( * ) Notice: Subject to any disclaimer, the term of this patent is extended or adjusted under 35 U.S.C. 154(b) by 50 days.

(21) Appl. No.: 11/811,428

(22) Filed: Jun. 8, 2007

(65) Prior Publication Data

US 2008/0302315 A1 Dec. 11, 2008

(51) Int. Cl.
*F24H 9/20* (2006.01)

(52) U.S. Cl. ..... 122/14.3; 122/429

(58) Field of Classification Search ..... 122/14.3, 122/14.31, 429
See application file for complete search history.

(56) References Cited

U.S. PATENT DOCUMENTS

| | | | | | |
|---|---|---|---|---|---|
| 2,123,809 | A | | 7/1938 | Seitz | |
| 2,602,465 | A | * | 7/1952 | Goehring | 137/582 |
| 2,766,200 | A | | 10/1956 | Kaufman | |
| 3,465,123 | A | * | 9/1969 | Harris | 392/454 |
| 3,726,475 | A | * | 4/1973 | Eising | 236/102 |
| 3,762,395 | A | | 10/1973 | Taylor | |
| 4,505,231 | A | * | 3/1985 | Syler | 122/159 |
| 4,898,124 | A | | 2/1990 | Granberg et al. | |
| 4,898,150 | A | * | 2/1990 | Lewis | 122/19.1 |
| 4,964,394 | A | | 10/1990 | Threatt | |
| 5,341,770 | A | * | 8/1994 | Lannes | 122/383 |
| 5,365,891 | A | | 11/1994 | Hanning | |
| 5,988,117 | A | * | 11/1999 | Lannes | 122/383 |
| 6,138,614 | A | * | 10/2000 | Shropshire | 122/13.3 |
| 6,267,085 | B1 | | 7/2001 | Alphs | |
| 6,508,208 | B1 | * | 1/2003 | Frasure et al. | 122/388 |
| 6,553,947 | B2 | | 4/2003 | Brandenbaugh | |
| 6,935,280 | B1 | | 8/2005 | Scott et al. | |

* cited by examiner

*Primary Examiner*—Gregory A Wilson
(74) *Attorney, Agent, or Firm*—Laurence A. Greenberg; Werner H. Stemer; Ralph E. Locher

(57) ABSTRACT

A high-efficiency water heater dip tube includes a wall having orifices formed therein for conducting an outflow of relatively colder water from the dip tube into relatively hotter water in an interior of a water heater. The orifices have a size, number, shape, pattern and location for at least minimizing turbulence, for reducing admixing near the tube, for diluting, equalizing and blending efflux flow and for reducing outflow force and speed. A method for reducing turbulence in water heaters includes providing a dip tube including a wall having orifices formed therein, conducting an outflow of relatively colder water from the dip tube into relatively hotter water in an interior of the water heater, and selecting a size, number, shape, pattern and location of the orifices for at least minimizing turbulence, reducing admixing near the tube, diluting, equalizing and blending efflux flow and reducing outflow force and speed.

26 Claims, 5 Drawing Sheets

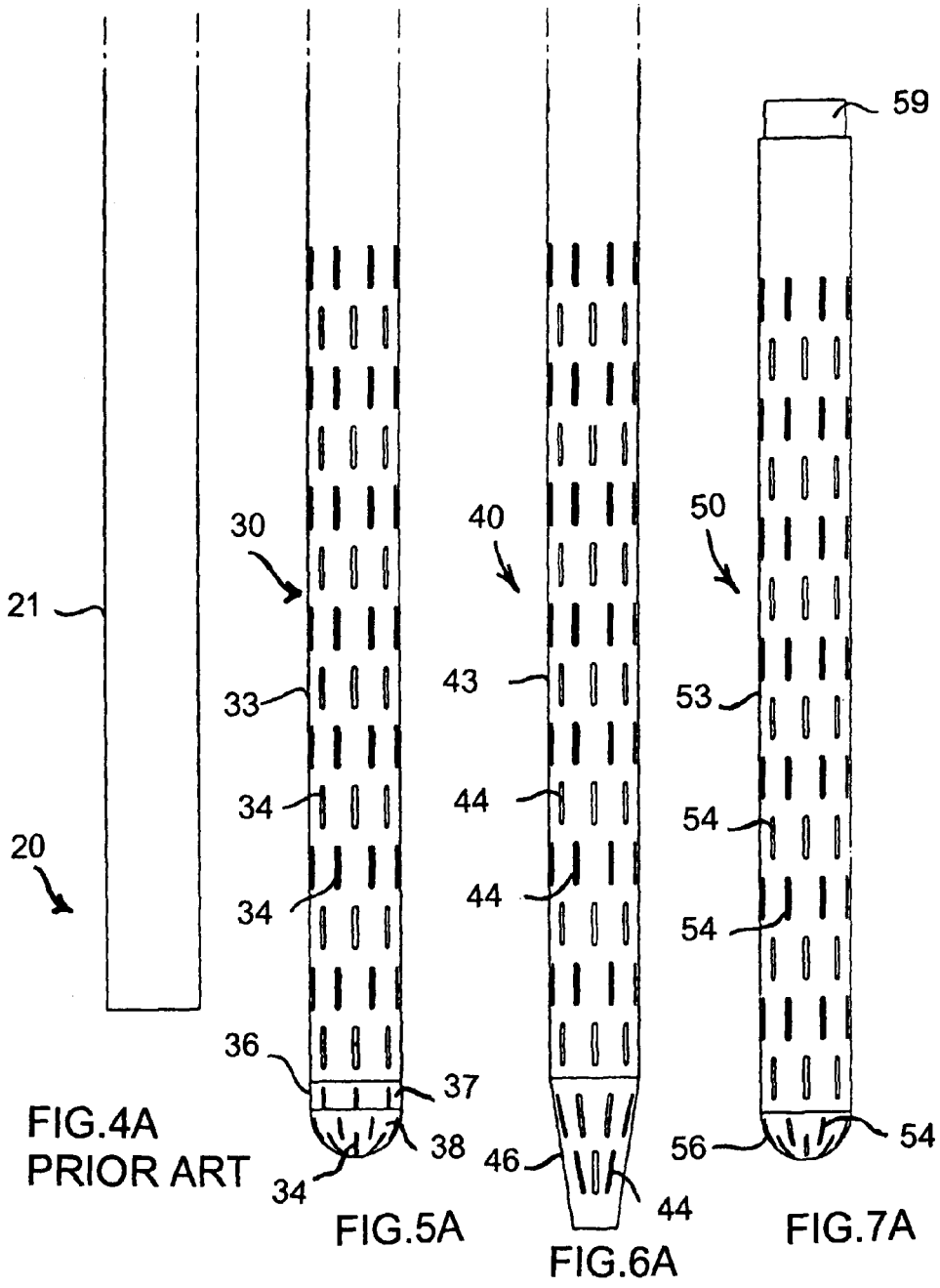
FIG.4A
PRIOR ART
FIG.5A
FIG.6A
FIG.7A
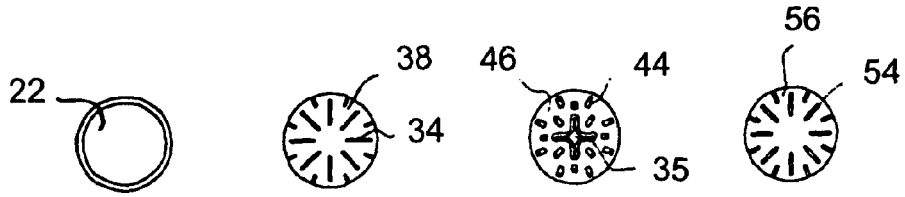
FIG.4B
PRIOR ART
FIG.5B
FIG.6B
FIG.7B 20
21
22
33
34
30
37
43
44
40
38
36

46
59
53
54
35

50
58

HIGH-EFFICIENCY WATER HEATER DIP TUBE AND METHOD FOR REDUCING TURBULENCE IN WATER HEATERS

BACKGROUND OF THE INVENTION

1. Field of the Invention:

The invention relates to a high-efficiency water heater dip tube. The invention also relates to a method for reducing turbulence in water heaters.

Water heater efficiency is impaired by the premature commingling or admixing of already heated water with the inflowing or incoming cold water. A truly efficient water heater could give up its entire caloric content with little reduction in outlet temperature by preventing the already heated water from admixing with the incoming cold water.

Preserving the separation and natural stratification or layering of heat content in water heaters is highly desirable and should be accomplished by the dip tube in bringing the cold inflowing water down to the bottom of the heating chamber while avoiding its mixing with the layers of hot water in the upper tank. Although the typical dip tube does pass to the bottom of the tank, the problem is that the cold inflowing water discharges from the bottom facing dip tube with a directed stream of high velocity liquid in a laminar flowing column, similar to a fire hose. The cold water immediately reflects away from the adjacent bottom wall with significant turbulence and admixes with the entire tank. Horizontal or curved dip tubes with unrestricted outflow create a revolving cyclone of turbulence, which ultimately may be worse than the bottom facing tube. Some dip tubes are made so short that they create a tumbling turbulence of direct convection mixing well within the mid and upper tank which is equal to removing or having no dip tube installed.

2. Description of the Related Art:

U.S. Pat. No. 6,138,614 to Shropshire discloses an inlet tube with a plurality of upper openings near the top of the tube, as is described in column 1, lines 39-40. The bottom opening causes water flowing out of the tube to agitate sediment deposits at the bottom of the tank, as is described in column 2, lines 1-2. The tube 28 has two upper openings 34, 38 therein near the top of the inlet tube 28, as is described in column 3 lines 21-22. The upper openings 34, 38 are circular, as is described in column 3 line 36. A combined upper surface area is approximately 0.0140 square inches, as is described in column 3 lines 41-42. The inlet tube 28 also includes four lower openings 42 facing outwardly, and arranged at 90 degree increments. The lower openings are circular, as is described in column 3, lines 51-53. The inlet tube has a bottom opening 46 at its bottom end that opens downwardly, as is described in column 4 lines 4-5. Water is forced out of the bottom opening 46, stirring up sediment deposits on the bottom wall 20 of the storage tank 18, and thereby helping to resist sediment buildup, as is described in column 4, lines 54-57. Water will stream out of the upper opening when the appropriate pressure is attained in the tube 28. The cold water exiting through the upper opening 34, 38 mixes with the hottest water in the storage tank 18, thereby cooling the hottest water and maintaining it below a selected temperature, as is described in column 4, lines 62-67.

U.S. Pat. No. 5,365,891 to Hanning uses a dip tube turbulator to facilitate the dislodgement of sediment from the lower tank wall, and therefore the primary purpose is sediment control.

U.S. Pat. No. 4,898,150 to Lewis reveals a dip tube sediment turbulator for balanced pressure water flow to all sides of the end piece, thereby eliminating directional torque on the dip tube itself, and thus the primary purpose is sediment control as well.

U.S. Pat. No. 2,123,809 to Seitz uses a deflector at the bottom of the dip tube, so that the incoming water is directed downward against the bottom of the boiler and the water at that point is agitated so as to stir up rust and other sediment therein. Therefore, the primary purpose is also sediment control.

U.S. Pat. No. 3,762,395 to Taylor provides means on the inner end of the cold water inlet for directing a jet of water issuing therefrom tangentially with respect to the vertical axis of the tank to prevent a build up of sediment on the bottom of the tank. The primary purpose in Taylor is sediment control.

U.S. Pat. No. 4,898,124 to Granberg presents not a top mounted, vertically oriented dip tube, but a scale agitator for tank type liquid heaters employing a flexible, non-cathodic tube through which liquid can flow". The primary purpose is once again sediment control.

U.S. Pat. No. 6,267,085 to Alphs presents not a top mounted, vertically oriented dip tube, but a cold water inlet bushing which screws into a threaded boss in the side wall of the hot water tank near the bottom. The Alphas device, which is not a dip tube, is for sediment control.

U.S. Pat. No. 4,505,231 to Syler teaches that a second curved plane has a plurality of openings in the underside thereof through which streams of water will be directed in the tank each time water is drawn out of the top of the tank. The streams of water serve to agitate the water in the bottom of the tank to prevent an accumulation of sediment therein. Once again, the device is not a dip tube and is intended for sediment control.

U.S. Pat. No. 6,935,280 to Scott shows a horizontal water inlet in the bottom of a water tank, with water flow deflectors to direct the water flow away from the flue and toward the side wall and bottom of the tank, thereby reducing an accumulation of scale. The device is again not a dip tube and is for sediment control.

U.S. Pat. No. 2,766,200 to Kaufman displays a bottom mounted water inlet, a baffle which is readily insertable into or removable from the tank after assembly, thereby facilitating coating of the inner surface of the tank, a protective anode for counteracting the electrolytic currents and a baffle connected to an influent pipe to provide stratification of the incoming water. The baffle is formed and disposed in such a way that it minimizes a "shadow effect" adjacent the influent pipe connection. The Kaufman device is not a dip tube, is used for electrolysis control and is not compatible with present systems.

U.S. Pat. No. 3,465,123 to Harris reveals a main function and purpose which is to direct and supply the incoming cold water from the city supply or other source so that it is concentrated within the vicinity of control means and is so focused and disposed that the discharged water plays on the control means and the heating element is caused to come on as soon as the hot water in the upper portion of the tank is drawn off for usage. The primary use is in controlling the thermostat and the dip tube is not of uniform diameter and is therefore not constructed for easy insertion or replacement after manufacture.

U.S. Pat. No. 4,964,394 to Threatt teaches a modified dip tube with a heat trap disposed therein. Threatt does not disclose a dip tube but instead a combined device which still enables strong laminar flow admixture.

U.S. Pat. No. 6,553,947 to Bradenbaugh shows means for improved mixing of cold water supply with water stored in the water tank of a water heater and means for limiting surges of water into and out of a water tank. The multipart system uses accessory water inlet and outlet regulators, a mid level tank baffle and intentionally augments premixing heated and unheated water at several levels, which defeats the purpose of having a dip tube.

U.S. Pat. No. 5,988,117 to Lannes presents an inlet which includes means for deflecting the water flow through openings in the inlet's wall in order to reduce the generation of temperature gradients that otherwise tend to develop within water heater tanks. Increased premixing defeats the purpose of the dip tube and reducing the temperature gradients worsens efficiency.

All of the prior art dip tubes inadvertently cause the very condition they were intended to prevent.

SUMMARY OF THE INVENTION

It is accordingly an object of the invention to provide a high-efficiency water heater dip tube and a method for reducing turbulence in water heaters, which overcome the hereinafore-mentioned disadvantages of the heretofore-known devices and methods of this general type and which reduce or eliminate turbulence in the interior of water heater tanks.

With the foregoing and other objects in view there is provided, in accordance with the invention, a high-efficiency water heater dip tube, comprising a wall having orifices formed therein for conducting an outflow of relatively colder water from the dip tube into relatively hotter water in an interior of a water heater. The orifices having a size, number, shape, pattern and location for at least minimizing turbulence, for reducing admixing near the tube, for diluting, equalizing and blending efflux flow and for reducing outflow force and speed. Therefore, the dip tube according to the invention works in a manner opposite to that of the prior art dip tubes by reducing turbulence and in turn reducing disturbance to the natural stratification or layering of heat content in the water heater.

In accordance with another feature of the invention, the orifices may be slot-shaped or slit-shaped, disposed in rows and columns, substantially evenly distributed entirely around the circumference of the wall, non-round and disposed in a staggered pattern in vertical columns. All of these features reduce turbulence and therefore increase the efficiency of the water heater.

In accordance with a further feature of the invention, the dip tube has an upstream end and a downstream end, in water flow direction. The orifices extend substantially to the downstream end. The dip tube also has a vertical section having the upstream end and a horizontal section following the vertical section in water flow direction and having the downstream end. The horizontal section has the orifices disposed therein and may be curved. Since the orifices extend substantially to the downstream end and in the horizontal section, they are disposed near the bottom of the tank where the water is coldest and yet do not disturb the natural heat layering in the tank.

In accordance with an added feature of the invention, an end cap is disposed at the downstream end and has the orifices disposed therein. The end cap may have a hemispherical shape or a frustoconical shape. The frustoconical end cap has a larger diameter end and a smaller diameter end. The larger diameter end faces upstream and the smaller diameter end faces downstream and has a preferably star-shaped opening formed therein. The end cap may also have a hemispherical portion and a cylindrical portion disposed between the downstream end and the hemispherical portion. The hemispherical portion and the cylindrical portion both have the orifices formed therein. These structures aid in spreading the oufflowing water to reduce or avoid turbulence. The orifices may become progressively longer or larger toward and in the end cap.

In accordance with an additional feature of the invention, the upstream portion and the downstream portion have a joint therebetween for removing and replacing the downstream portion. The joint may include a stepped or reduced diameter region on one of the portions. This structure facilitates retrofitting existing dip tubes or replacing clogged or worn dip tube ends.

With the objects of the invention in view, there is also provided a method for reducing turbulence in water heaters. The method comprises providing a dip tube including a wall having orifices formed therein. An outflow of relatively colder water is conducted from the dip tube into relatively hotter water in an interior of the water heater. A size, number, shape, pattern and location of the orifices is chosen for at least minimizing turbulence, reducing admixing near the tube, diluting, equalizing and blending efflux flow and reducing outflow force and speed.

The dip tube according to the invention improves water heater efficiency by reducing dip tube induced tank turbulence by:

1. using special tank turbulence preventing outlet orifices which avoid large diameter, round, laminar or projectional dip tube out-flow;
2. using special tank turbulence preventing orifices which create localized energy absorbing micro turbulences at the orifice surface and containing any admixing to within millimeters of the outlets;
3. using directionally separated, tank turbulence preventing orifices on all lateral and end walls of the dip tube so that the efflux flow is diluted evenly and spherically blended in close proximity without projection in any one direction;
4. using many special tank turbulence preventing orifices in sufficient numbers, shapes, directions and sizes to exceed the dip tube lumen surface area sufficiently to markedly reduce the dip tube out-flow force and speed; and
5. using progressively enlarging outlet orifices in the downstream or distal direction matching the progressive lessening of the intra-luminal pressure and velocity to ensure a lengthwise equalization of the outflow along the entire outflow area of the dip tube.

In order to bring higher efficiency to existing water heater technology, the dip tube according to the invention retains complete compatibility with present water heater construction, manufacturing and part interchangeability by:

1. preventing elevated intra-luminal dip tube pressure by altering flow without restricting flow to allow continued construction with the same or similar materials;
2. retaining the consistent similar diameter parallel wall construction with large radius turns and with varying available lengths and styles to permit its continued installation through and compatibility with standard water heater inlet fittings which allows unchanged manufacturing procedures and the direct replacement or retrofitting of existing water heater dip tubes; and
3. providing a dampened energy dip tube which can be placed much lower in existing water tanks and closer to either the side wall or bottom surface without interference or untoward turbulence, thus bringing higher efficiency to existing systems.

Other features which are considered as characteristic for the invention are set forth in the appended claims.

Although the invention is illustrated and described herein as embodied in a high-efficiency water heater dip tube and a method for reducing turbulence in water heaters, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 4A, 4B and 4C are respective front-elevational, bottom-plan and perspective views of a prior art dip tube;

FIGS. 5A, 5B and 5C are respective front-elevational, bottom-plan and perspective views of a dip tube according to a first embodiment of the invention having cut orifices and an attached end cap;

FIGS. 6A, 6B and 6C are respective front-elevational, bottom-plan and perspective views of a dip tube according to a second embodiment of the invention having formed or cut orifices with a formed-on end and FIG. 6D shows the orifices becoming progressively longer and larger toward the end cap in a perspective view; and FIGS. 7A, 7B and 7C are respective front-elevational, bottom-plan and perspective views of an attachable outlet section of a dip tube according to a third embodiment of the invention having formed or cut orifices.

DESCRIPTION OF THE PREFERRED EMBODIMENTS

Figure 1:
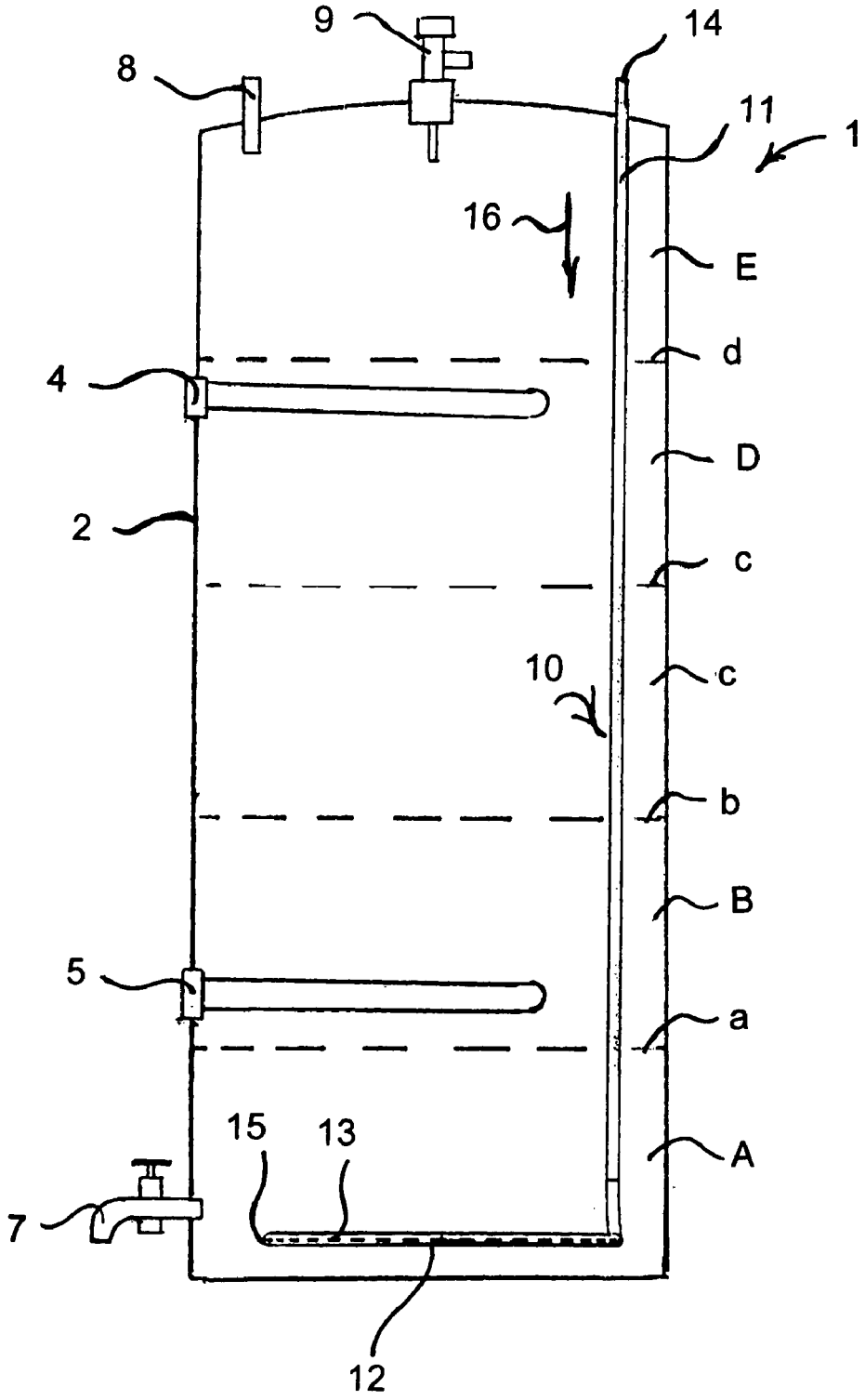
FIG. 1 is a diagrammatic, longitudinal-sectional view, as seen from the front, of a typical electric water heater, employing a high-efficiency dip tube according to the invention with vertical and horizontal sections.

Referring now to the figures of the drawings in detail and first, particularly, to FIG. 1 thereof, there is seen a typical electric hot water heater 1 having a tank with an outer casing 2. Heating elements 4 and 5 protrude from the outer casing 2 into the interior of the tank. A drain 7 is disposed near the bottom of the tank and a hot water outlet 8 and a pressure relief valve 9 are disposed at the top of the water heater 1. Of course, the invention could be used in a gas hot water heater as well.

Lines a, b, c and d illustrated in FIG. 1 demarcate layers of heated water in the tank of the water heater 1. More specifically, there is a cold layer A, a warm layer B, a hot layer C, a hotter layer D and a hottest layer E.

Figure 2:
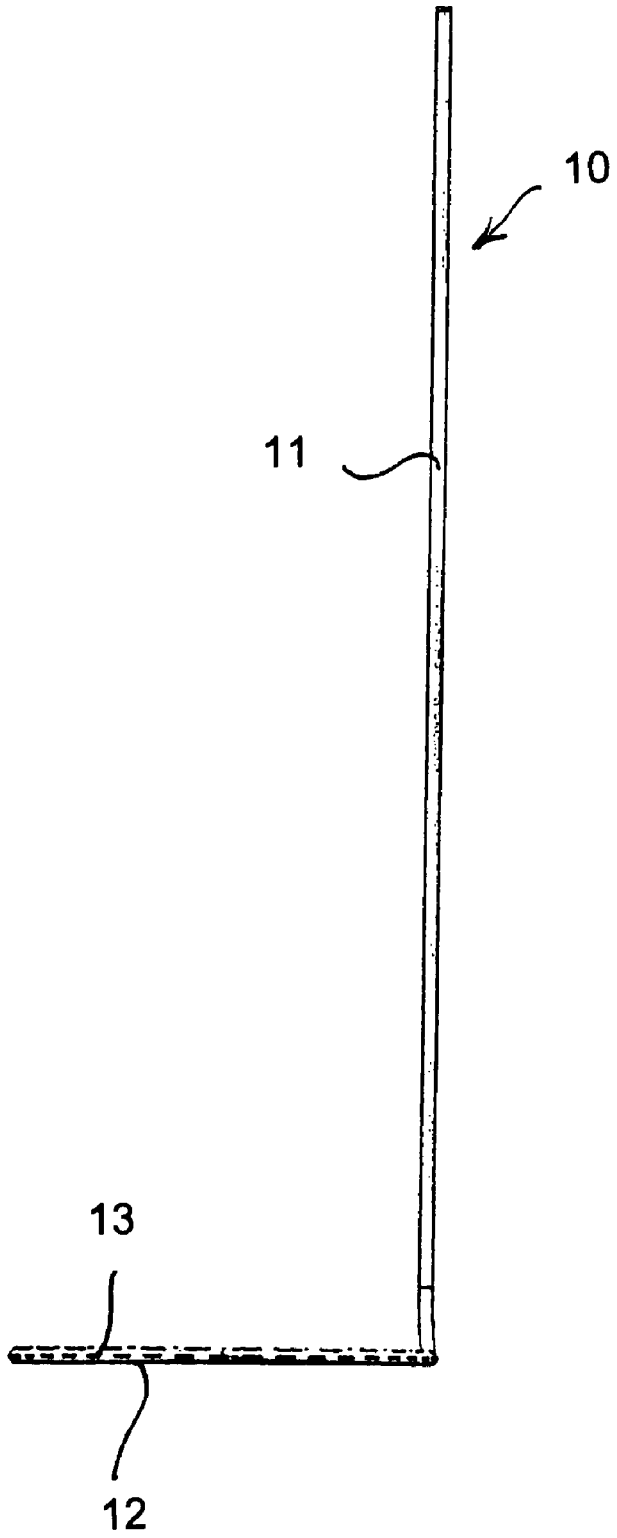
FIG. 2 is a front-elevational view showing a full-length of the dip tube according to the invention with the vertical and horizontal sections.
Figure 3:
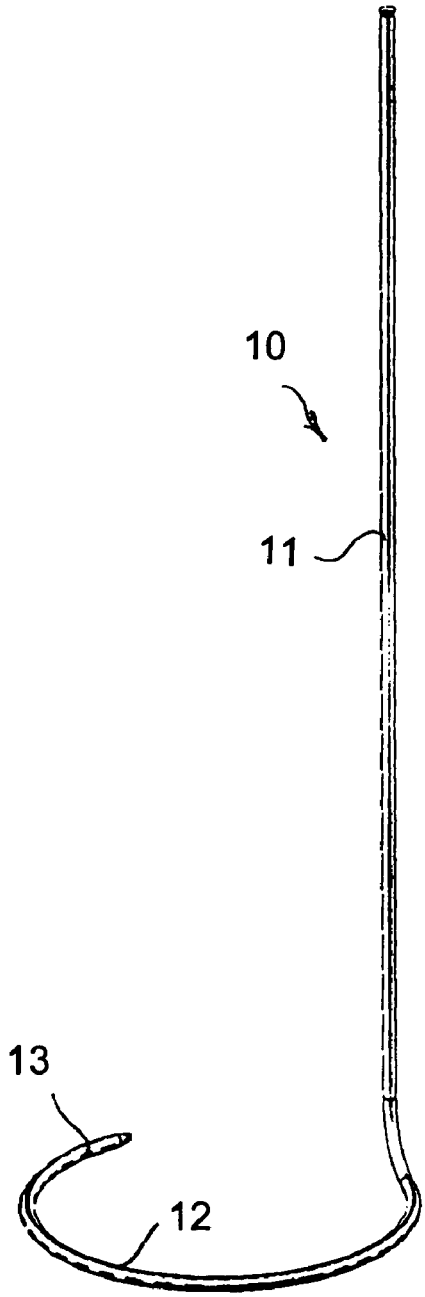
FIG. 3 is a front-perspective view of the dip tube according to the invention shown in FIG. 2.

A high-efficiency dip tube 10 according to the invention has a vertical section 11 with an upstream, inlet or proximal end 14 and an additional horizontal section 12 with a downstream, outlet or distal end 15, as seen in water flow direction represented by an arrow 16. Outlet orifices 13 are formed in the horizontal section 12. FIGS. 2 and 3 show the high-efficiency water heater dip tube 10 in respective elevational and perspective views, from which it can be seen that the horizontal section 12 is curved. The orifices 13 are shown in greater detail in FIGS. 5A-5C, 6A-6C and 7A-7C.

Figures 4C, 5C, 6C, 6D, 7C:
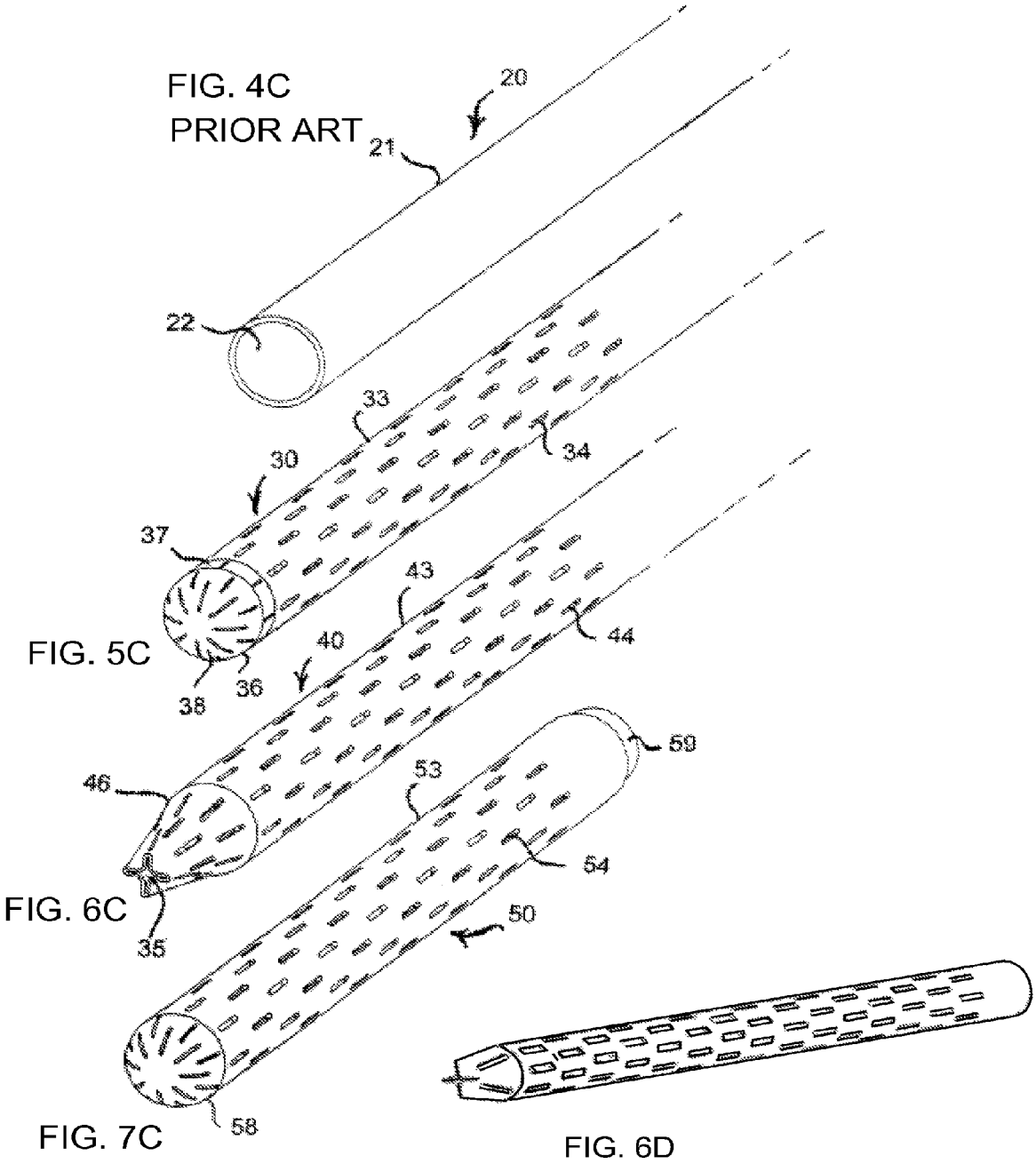
FIG. 4C PRIOR ART

FIGS. 4A, 4B and 4C are respective front, bottom and perspective views of a prior art water heater dip tube 20 having a fully-closed vertical section 21 with a fully-open bottom region 22. Relatively cold water emerging from the open bottom region 22 will create turbulence in the interior of the tank of the water heater 1 and disturb the highly desirable separation and natural stratification or layering of the layers A-E of heat content. Even though the open bottom region 22 may be disposed at the bottom of the heating chamber or interior, the cold inlet water will mix with the layers of hot water in the upper layers of the tank as it discharges from the bottom with a directed stream of high velocity liquid in a laminar flowing column like a fire hose. The cold water is deflected upward from the bottom of the tank with turbulence and admixes with the water in the entire tank.

A horizontal or curved dip tube with an unrestricted outflow will create a revolving cyclone of turbulence which may be worse than the bottom facing tube. Some dip tubes are made so short that they create a tumbling turbulence of direct convection mixing well within the mid and upper tank, being the equivalent of having no dip tube at all.

FIGS. 5A, 5B and 5C are respective front, bottom and perspective views of a high-efficiency dip tube 30 according to a first embodiment of the invention. The dip tube 30 has a body or wall 33 in which slot-shaped or slit-shaped orifices 34 are cut or formed. An end cap 36 has a cylindrical portion 37 and a domed or hemispherical portion 38, both of which also have the orifices 34 cut or formed therein. It may be seen that the orifices become progressively longer or otherwise larger toward and in the end cap.

FIGS. 6A, 6B and 6C are respective front, bottom and perspective views of a high-efficiency dip tube 40 according to a second embodiment of the invention. The dip tube 40 has a wall 43 in which slot-shaped or slit-shaped orifices 44 are cut or formed. An end cap 46 has a frustoconical shape and also has the orifices 44 cut or formed therein. It may be seen that the orifices become progressively longer or otherwise larger toward and in the end cap. The end cap 46 has a star-shaped nozzle opening 35 at an outlet end thereof which directs water in four different directions to avoid turbulence.

FIG. 6D shows the orifices becoming progressively longer and larger toward the end cap.

FIGS. 7A, 7B and 7C are respective front, bottom and perspective views of a high-efficiency dip tube 50 according to a third embodiment of the invention. The dip tube 50 has a wall 53 in which slot-shaped or slit-shaped orifices 54 are cut or formed. An end cap 56 has a domed or hemispherical shape and also has the orifices 54 cut or formed therein. It may be seen that the orifices become progressively longer or otherwise larger toward and in the end cap.

The body of the dip tube 50 has an upstream portion and a downstream portion with a joint therebetween for removing and replacing the downstream portion. The joint includes a stepped or reduced diameter region 59 on one of the portions. In the illustrated embodiment, the outer periphery or surface 53 of the downstream portion has the stepped or reduced diameter region 59 to be inserted into the upstream portion of the dip tube for lengthening or shortening the entire dip tube to correspond to a given water heater height. A screw or snap connection could also be used for the joint. The portion 59 also makes it easy to replace the section of the dip tube shown in FIGS. 7A-7C, for instance if the tube or the orifices become clogged.

In each of the embodiments of the invention, the size, number, shape, pattern and location of the orifices are specifically chosen to prevent or at least minimize turbulence, to reduce admixing near the tube, to dilute, equalize and blend efflux flow and to reduce outflow force and speed. The orifices 34, 44, 54 are preferably substantially evenly distributed entirely around the circumference or periphery of the wall 33, 43, 53. The phrase substantially evenly distributed entirely around the circumference or periphery means that the distribution is sufficiently even to avoid turbulence. Large diameter, round, projecting and high-pressure openings are specifically avoided. The staggered or offset pattern of rows and columns in the figures are only shown as an example and may be varied. The size, number, shape, pattern and location of the orifices 34, 44, 54 represent means for at least minimizing turbulence, reducing admixing near the tube, diluting, equalizing and blending efflux flow and reducing outflow force and speed of the relatively colder water from the orifices 34, 44, 54.

The dip tubes according to the invention can be retrofitted into existing water heaters having dip tubes which create turbulence. The dip tubes according to the invention can be made of any material and in any shape, length or style used for conventional dip tubes and can also be placed closer to the bottom surface or side wall of the water heater than conventional dip tubes, because turbulence is avoided.

I claim:

1. A water heater dip tube for improving efficiency, comprising:

a wall having orifices formed therein for conducting an outflow of relatively colder water from the dip tube into relatively hotter water in an interior of a water heater, said wall including a distal horizontal portion;

said orifices having a size, number, shape, pattern and location for at least minimizing turbulence, for reducing admixing near the tube, for diluting, equalizing and blending efflux flow and for reducing outflow force and speed; and said orifices being non-laminar flow, slit-like orifices disposed along said distal horizontal portion in off-set, overlapping, staggered rows and columns in order to minimize admixture while maintaining a maximum structural strength of the wall of the dip tube.

2. The dip tube according to claim 1, wherein said orifices are substantially evenly distributed entirely around the circumference of the distal horizontal portion of the wall.

3. The dip tube according to claim 1, wherein said orifices are disposed in a linear, offset, staggered pattern in vertical columns for minimizing admixture and maximum strength of the wall of the dip tube.

4. The dip tube according to claim 1, which further comprises an upstream end and a downstream end, in water flow direction, said orifices extending substantially to said downstream end.

5. The dip tube according to claim 4, which further comprises a vertical section having said upstream end and a horizontal section following said vertical section in water flow direction and having said downstream end, said horizontal section having said orifices disposed therein.

6. The dip tube according to claim 5, wherein said horizontal section is curved.

7. The dip tube according to claim 1, which further comprises an upstream end and a downstream end, in water flow direction, and an end cap disposed at said downstream end and having said orifices disposed therein.

8. The dip tube according to claim 7, wherein said end cap has a hemispherical shape.

9. The dip tube according to claim 7, wherein said end cap has a hemispherical portion and a cylindrical portion disposed between said downstream end and said hemispherical portion, said hemispherical portion and said cylindrical portion both having said orifices formed therein.

10. The dip tube according to claim 1, which further comprises an upstream portion and a downstream portion having a joint therebetween for removing and replacing said downstream portion.

11. The dip tube according to claim 10, wherein said joint includes a stepped or reduced diameter region on one of said portions.

12. A method for reducing turbulence in water heaters, the method comprising the following steps:

providing a dip tube according to claim 1 including the wall having orifices formed therein;

conducting an outflow of relatively colder water from the dip tube into relatively hotter water in an interior of the water heater; and selecting a size, number, shape, pattern and location of the orifices for at least minimizing turbulence, reducing admixing near the tube, diluting, equalizing and blending efflux flow and reducing outflow force and speed.

13. The dip tube according to claim 1, wherein said orifices discharge directly into the interior of the water heater.

14. The dip tube according to claim 1, which further comprises an inlet end and an outlet end between which the dip tube conducts the water in only one direction.

15. The dip tube according to claim 1, wherein the dip tube is formed in one piece.

16. The dip tube according to claim 1, wherein said orifices discharge near the bottom of the interior of the water heater.

17. The dip tube according to claim 1, wherein said orifices discharge along a flat bottom of the interior of the water heater.

18. A water heater, comprising:

an interior having a top and a flat bottom; and a one-piece dip tube according to claim 1 having an inlet end at said top of said interior and the slit-like outlet orifices near said flat bottom of said interior;

said dip tube conducting water in only one direction between said inlet end and said outlet orifices;

said outlet orifices conducting an outflow of relatively colder water from said dip tube directly into relatively hotter water in said interior.

19. A water heater dip tube for improving efficiency, comprising:

a wall having orifices formed therein for conducting an outflow of relatively colder water from the dip tube into relatively hotter water in an interior of a water heater, said wall including a distal horizontal portion;

said orifices having a size, number, shape, pattern and location for at least minimizing turbulence, for reducing admixing near the tube, for diluting, equalizing and blending efflux flow and for reducing outflow force and speed; and said orifices being non-laminar flow, slit-like, cut or formed orifices disposed along said distal horizontal portion in off-set, overlapping, staggered rows and columns in order to prevent laminar, flow reduce flow projections, and reduce admixing of incoming cold water with already heated water.

20. A water heater dip tube for improving efficiency, comprising:

a wall having orifices formed therein for conducting an outflow of relatively colder water from the dip tube into relatively hotter water in an interior of a water heater;

said orifices having a size, number, shape, pattern and location for at least minimizing turbulence, for reducing admixing near the tube, for diluting, equalizing and blending efflux flow and for reducing outflow force and speed;

an upstream end and a downstream end, in water flow direction; and an end cap disposed at said downstream end and having said orifices disposed therein, said end cap having a frustoconical shape.

21. The dip tube according to claim 20, wherein said frustoconical end cap has a larger diameter end and a smaller diameter end, said larger diameter end faces upstream and said smaller diameter end faces downstream and has an opening formed therein.

22. The dip tube according to claim 21, wherein said opening is star-shaped for reducing turbulence.

23. A water heater, comprising:

an interior having a top and a flat bottom; and a one-piece dip tube according to claim 20 having an inlet end at said top of said interior and the slit-like outlet orifices near said flat bottom of said interior;

said dip tube conducting water in only one direction between said inlet end and said outlet orifices;

said outlet orifices conducting an outflow of relatively colder water from said dip tube directly into relatively hotter water in said interior.

24. A water heater dip tube for improving efficiency, comprising:

a wall having orifices formed therein for conducting an outflow of relatively colder water from the dip tube into relatively hotter water in an interior of a water heater;

said orifices having a size, number, shape, pattern and location for at least minimizing turbulence, for reducing admixing near the tube, for diluting, equalizing and blending efflux flow and for reducing outflow force and speed;

an upstream end and a downstream end, in water flow direction; and an end cap disposed at said downstream end and having said orifices disposed therein, said orifices becoming progressively longer or larger toward and in said end cap.

25. A water heater, comprising:

an interior having a top and a flat bottom; and a one-piece dip tube according to claim 24 having an inlet end at said top of said interior and the slit-like outlet orifices near said flat bottom of said interior;

said dip tube conducting water in only one direction between said inlet end and said outlet orifices;

said outlet orifices conducting an outflow of relatively colder water from said dip tube directly into relatively hotter water in said interior.

26. A water heater dip tube for improving efficiency, comprising:

a wall having orifices formed therein for conducting an outflow of relatively colder water from the dip tube into relatively hotter water in an interior of a water heater; and means for at least minimizing turbulence, reducing admixing near the tube, diluting, equalizing and blending efflux flow and reducing outflow force and speed of the relatively colder water from said orifices.

* * * * *